US006212929B1

(12) United States Patent
Binhack

(10) Patent No.: US 6,212,929 B1
(45) Date of Patent: Apr. 10, 2001

(54) DEVICE AND METHOD FOR FORMING, IN PARTICULAR COLD-FORMING, WORKPIECES

(76) Inventor: Fritz Binhack, Zum Kleinen Feld 2, D-75015 Bretten (DE)

( * ) Notice: Subject to any disclaimer, the term of this patent is extended or adjusted under 35 U.S.C. 154(b) by 0 days.

(21) Appl. No.: 09/485,806

(22) PCT Filed: Jul. 31, 1998

(86) PCT No.: PCT/EP98/04800

§ 371 Date: Feb. 11, 2000

§ 102(e) Date: Feb. 11, 2000

(87) PCT Pub. No.: WO99/08813

PCT Pub. Date: Feb. 25, 1999

(30) Foreign Application Priority Data

Aug. 16, 1997 (DE) ..... 197 35 486

(51) Int. Cl.[7] ..... B21C 23/00

(52) U.S. Cl. ..... 72/273.5; 72/253.1; 72/271

(58) Field of Search ..... 72/253.1, 271, 72/273.5, 437, 438, 453.1, 453.11

(56) References Cited

U.S. PATENT DOCUMENTS 3,550,417 12/1970 McMaster .
3,572,080 * 3/1971 Alexoff et al. ..... 72/273.5
3,585,832 6/1971 Hinshaw et al. .
3,707,866 * 1/1973 Brauer ..... 72/453.11
3,818,799 * 6/1974 Hague ..... 72/438
4,131,164 * 12/1978 Hague et al. ..... 72/438

FOREIGN PATENT DOCUMENTS 1929558 12/1970 (DE) .
1364019 3/1994 (FR) .

* cited by examiner

*Primary Examiner*—Ed Tolan
(74) *Attorney, Agent, or Firm*—Horst M. Kasper

(57) ABSTRACT

Described is an apparatus for the cold-forming, in particular for the cold extrusion of a workpiece, which has a die (3) and a feeding device (5) by means of which a relative motion can be produced between the workpiece (2) and the die (3). It is provided that the apparatus (1; 1') has a frequency generating device (10) working together with the feeding device (5) by means of which the relative motion between workpiece (2) and die (3), produced by the feeding device (5), can be modulated in such a way that after a forward stroke, in which the workpiece (2) and/or the die (3) is moved a first stroke length in the direction of feed (P), in a subsequent reverse stroke, a movement of the die (3) and/or of the workpiece (2) by a second stroke length can be carried out in a direction contrary to the direction of feed (P).

18 Claims, 1 Drawing Sheet

DEVICE AND METHOD FOR FORMING, IN PARTICULAR COLD-FORMING, WORKPIECES

Figure 1:
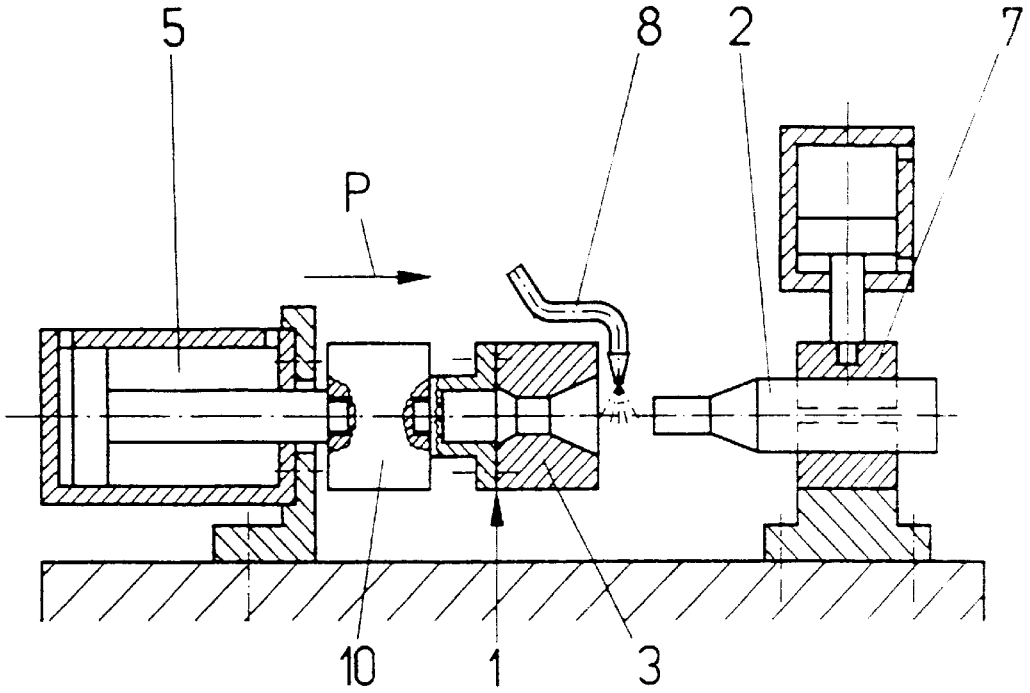

This application is a 371 of PCT/EP98/04800 filed Jul. 31, 1998.

DESCRIPTION

The invention relates to an apparatus for the forming, in particular for the cold-forming, in this case in particular for the cold extrusion, of a workpiece, the apparatus comprising a die and a feeding device by means of which a relative motion between the workpiece and the die can be realized, as well as to a method for the forming, in particular for the cold-forming of a workpiece, wherein a relative motion between a workpiece and a die is produced by means of a feeding device.

Such apparatus and method are generally known and therefore do not have to be described in greater detail. The disadvantage of known apparatuses and methods are that high feed forces are required to achieve the desired cold-forming of the workpiece.

From U.S. Pat. No. 4,197,757, a method and an apparatus for cold-forming of a workpiece is known by means of which the latter can be transformed into the desired geometric configuration. For this, it is provided that the workpiece is inserted in a recess while the recess is open, that one end of the recess with the workpiece accommodated therein is closed and an anvil is arranged at the other end in order to form an annular space between anvil and the wall of the recess, that the annular space then is closed and a first pressure is exerted on a selected area of the workpiece in such a way that an extrusion of the workpiece starts via the anvil and the recess is filled. Afterwards, the volume of the annular space between the anvil and the wall of the recess, in which the workpiece is extruded, is increased while an essentially uniform second pressure, which is contrary to the direction of flow of the metal, is exerted on the workpiece in which case the magnitude of the second pressure is smaller than that of the first pressure whereby the metal essentially flows uniformly during the extrusion. The apparatus provided for carrying out the method has a mechanism with which the anvil can be moved back and forth.

The object of the present invention is to provide an improved apparatus and method such that a reduction of the feed forces required for the forming, in particular a cold-forming, of a workpiece is achieved.

This problem is solved by an apparatus according to the invention in that the apparatus has a frequency generating device working together with the feeding device by means of which the relative motion between workpiece and die caused by the feeding device can be modulated in such a way that after a forward stroke, in which at least one of the workpiece and the die is moved a first stroke length in the direction of feed, in a subsequent reverse stroke, a movement of at least one of the die and the workpiece by a second stroke length can be carried out in a direction contrary to the direction of feed.

Through the measures according to the invention, it is achieved in an advantageous way that the feed force which is required for the forming, in particular for the cold-forming, for example, a cold extrusion of a workpiece, and which is needed for the realization of a defined final forming of the workpiece, is considerably smaller than in a conventional apparatus. This does not only lead to that the energy required for the operation of the apparatus according to the invention is reduced and a clear saving in energy is achieved. The smaller forces occurring during the forming with the apparatus according to the invention allow also a simpler and therefore less expensive type of construction of the apparatus according to the invention whereby the production costs also are reduced. The "hammerlike" force impacting of the to-be-cold-formed workpiece by the intermittent, stroke-like feed movement allows in an advantageous way a high-quality cold-forming with minimal effort and wear. Another advantage consists in that the workpiece is subject to only small axial forces so that buckling and deformation, also in the form of bulging, to a large extent are prevented.

Other advantageous, further developments of the invention are the subject-matter of the dependent claims.

Further particulars and advantages of the invention are to be inferred from the exemplary embodiments which are described in the following with the aid of the figures. Here, FIG. 1 shows a first embodiment of an apparatus of the invention, and FIG. 2 shows a second embodiment of the apparatus.

Figure 2:
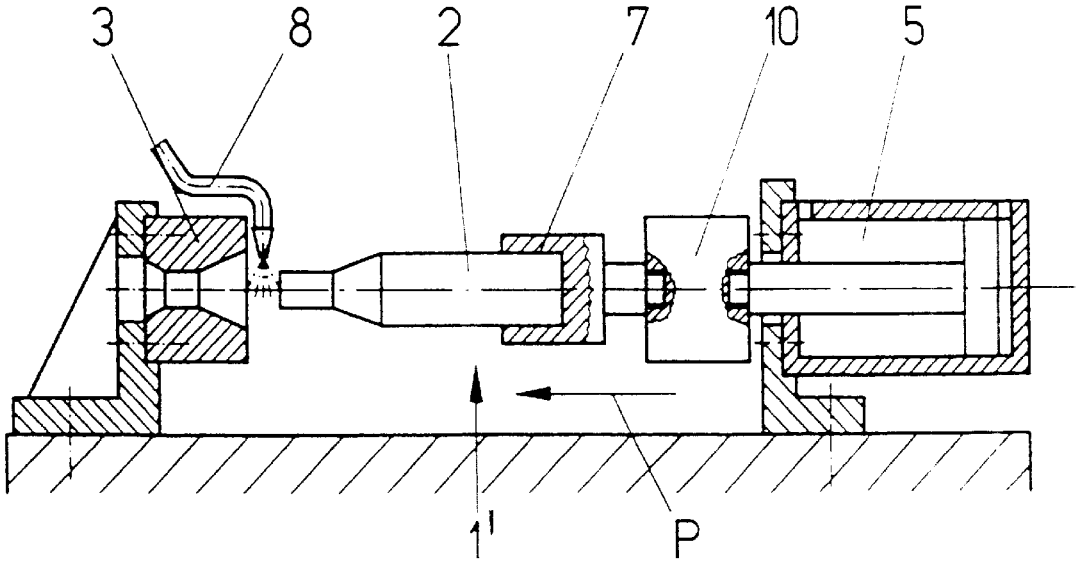

The first embodiment, shown in FIG. 1, of an apparatus 1 for the cold-forming, in particular for the cold extrusion, of a workpiece 2 has a die 3 which can be moved relative to the workpiece 2 by means of a feeding device 5. The feeding device 5 thus produces a relative motion between die 3 and the workpiece 2 held in a clamping apparatus 7. If the die 3 is moved by means of feeding device 5 in its direction of feed P against the workpiece 2, clamped stationary in the case shown here, the workpiece 2 enters the die 3 and is cold-formed in a way known to a person skilled in the art.

Since with the apparatus 1, it is now provided that, in contrast to a known apparatus with which the feeding device brings about a continuous movement in the direction of feed P, the movement in the direction of feed P is modified by a frequency generating device 10 in such a way that the die 3 executes, instead of a uniformly proceeding movement in the direction of feed P, a strokelike movement in which it is provided that after a forward stroke in the direction of feed P, in which the die 3 is moved forward by a first stroke length, the die 3 in a subsequent reverse stroke is pulled back by means of the feeding device 5 by a second stroke length. In the subsequent forward stroke, the die 3 is again moved forward, in fact beyond the end point of the previous forward stroke. Through this "hammerlike" impacting of the workpiece 2 by the die 3, it is achieved in an advantageous way that the die 3, before its impact on the area of the workpiece 2 to be worked in the next step, has a higher kinetic energy than is the case with a continuous force impact since the reverse movement of the die 3, before its renewed acceleration by means of the feeding device 5 in the direction of feed P, brings about that in the feed movement, the die 3 moves along the area of the workpiece 2 already cold-formed in the previous forward stroke and can pass this area generally without any friction. In addition, the retraction of the die 3 before the next step of the cold-forming operation leads to that hereby an improved supply of lubricant, which is fed through a lubricant supply unit 8 shown schematically in FIG. 1, is achieved.

In the case of the apparatus 1 it is preferred that the frequency produced by the frequency generating device 10, modulating the forward movement of the die 3 in the direction of feed P, is in the range of about 5 to 30 Hz and preferably is 10 to 20 Hz.

It is moreover preferred that the second stroke length of the reverse movement of the die 3 generally is only half of the first stroke length provided in the feed.

The frequency generating device 10 in this case can operate hydraulically, pneumatically or mechanically. However, an electromagnetic generation of the frequency, modulating the feed movement of the feeding device 5, is also conceivable in certain cases.

But it is also possible to integrate the frequency generating device 10 in the feeding device 5 so that the feed movement produced by the feeding device 5 is modulated directly. This can take place in particular in that the oil supply of a feed cylinder 5' of the feeding device 5 is controlled servo hydraulically or proportional-hydraulically so that the cylinder 5' bringing about the feed of the die 3 oscillates periodically.

The second embodiment of an apparatus 1', represented in FIG. 2, corresponds generally to the apparatus 1 of the first embodiment so that identical parts are provided with the same reference numbers and do not have to be described in greater detail any more. The principal difference between the two embodiments consists in that in the case of the apparatus 1', the die 3 is arranged stationary while the workpiece 2 can be moved axially towards the die 3. Consequently, the feeding device 5 and the frequency generating device 10, working together with it, acts on the workpiece 2 or on the clamping device 7 holding the workpiece 2.

What is claimed is:

1. Apparatus for the forming, in particular for the cold-forming or cold extrusion, of an elongated workpiece having a longitudinal direction, which has a die (3) and a feeding device (5), by means of which a relative motion in a direction of feed (P) between the workpiece (2) and the die (3) is realized, said direction of feed (P) coinciding with the longitudinal direction of the workpiece (2) characterized in that the apparatus (1; 1') has a frequency generating device (10) which works together with the feeding device (5) and by means of which the relative motion between workpiece (2) and die (3), produced by the feeding device (5), is modulated in such a way that after a forward stroke, in which at least one of the workpiece (2) and the die (3) is moved a first stroke length in the direction of feed (P), in a subsequent reverse stroke, a movement of at least one of the die (3) and the workpiece (2) by a second stroke length is carried out in a direction contrary to the direction of feed (P).

2. Apparatus according to claim 1, characterized in that the modulation of feed movement of at least one of the workpiece (2) and the die (3), brought about by the frequency generating device (10), is such that the first stroke length covered in the forward stroke in the direction of feed (P) is greater than the second stroke length covered in the subsequent reverse stroke.

3. Apparatus according to claim 2, characterized in that the first stroke length covered in the forward stroke is approximately twice as great as the second stroke length being covered in the reverse stroke.

4. Apparatus according to claim 1, characterized in the that modulation frequency produced by the frequency generating apparatus (10) is in the range of about 5 to 30 Hz.

5. Apparatus according to claim 4, characterized in that the modulation frequency produced by the frequency generating apparatus (10) is in the range between 10 and 20 Hz.

6. Apparatus according to claim 1, characterized in that the feeding device (5) and the frequency generating device (10), working together with it, act on the die (3).

7. Apparatus according to claim 1, characterized in that the feeding device (5) and the frequency generating device (10), working together with it, act on the workpiece (2).

8. Apparatus according to claim 1, characterized in that the feeding device (5) and the frequency generating device (10), working together with it, act on the die (3) and the workpiece (2).

9. Apparatus according to claim 1, characterized in that the frequency generating device (10) is a hydraulically, pneumatically, mechanically or electromagnetically operating frequency generating device.

10. Apparatus according to claim 1, characterized in that the frequency generating device (10) is integrated in the feeding device (5) in such a way that the feed movement produced by the feeding device (5) is modulated directly.

11. Apparatus according to claim 10, characterized in that a feeding element (5') of the feeding device (5) is controlled servo-hydraulically or proportional-hydraulically.

12. Method for the forming of a workpiece in which a relative motion is produced between an elongated workpiece having a longitudinal direction and a die (3) by a feeding device (5), said direction of feed (p) coinciding with the longitudinal direction of the workpiece (2), characterized in that the relative motion between the workpiece (2) and the die (3), produced by the feeding device (5), is modulated in such a way that after a forward stroke, in which at least one of the workpiece (2) and the die (3) is moved a first stroke length in the direction of feed (P), in a subsequent reverse stroke, a movement of at least one of the die (3) and of the workpiece by a second stroke length is carried out in a direction contrary to the direction of feed (P).

13. Method according to claim 12, characterized in that the first stroke length, covered in the forward stroke in the direction of feed (P), is greater than the second stroke length covered in the subsequent reverse stroke.

14. Method according to claim 13, characterized in that the first stroke length, covered in the direction of feed, is approximately twice as great as the second stroke length being covered in the reverse stroke.

15. Method according to claim 12, characterized in that a modulation frequency modulating the relative motion is in the range of 5 to 30 Hz, and preferably between 10 and 20 Hz.

16. Method according to claim 12, characterized in that the die (3) is moved by the feeding device (5) and a frequency generating device (10), producing the modulation frequency, which works together with it.

17. Method according to claim 12, characterized in that the workpiece (2) is moved by the feeding device (5) and the frequency generating device (10) working together with it.

18. Method according to claim 12, characterized in that the die (3) and the workpiece (2) are moved by the feeding device (5) and the frequency generating device (10) working together with it.

* * * * *